US005322177A

United States Patent [19]

Coggings

[11] Patent Number: 5,322,177

[45] Date of Patent: Jun. 21, 1994

[54] SCREW CAP CLOSURE FOR A DRUM

[75] Inventor: Nigel Coggings, West Yorkshire, England

[73] Assignee: Tanks and Drums Limited, West Yorkshire, England

[21] Appl. No.: 984,885

[22] Filed: Dec. 2, 1992

[30] Foreign Application Priority Data

Dec. 5, 1991 [GB] United Kingdom ..... 9125940

[51] Int. Cl.[5] ..... B65D 41/06

[52] U.S. Cl. ..... 220/288; 220/240; 220/295; 220/296; 220/601; 220/768; 220/773; 220/304

[58] Field of Search ..... 220/298, 240, 293, 295, 220/296, 601, 656, 659, 768, 773, 288, 304, 608, 609, 89.1

[56] References Cited

U.S. PATENT DOCUMENTS

| | | | |
|---|---|---|---|
| Re. 1,593 | 12/1863 | Spratt | 220/288 |
| 104,193 | 6/1870 | Perkins | 220/288 |
| 483,575 | 10/1892 | McNabb | 220/288 |
| 1,915,300 | 6/1933 | Draper | 220/288 |
| 1,980,995 | 11/1934 | Holloway . | |
| 2,197,609 | 4/1940 | Cornell, Jr. | 220/288 X |
| 2,770,382 | 11/1956 | Ritter | 215/31 |
| 2,818,204 | 12/1957 | Henchert et al. | 220/296 X |
| 3,289,891 | 12/1966 | Frankenberg | 220/288 X |
| 3,297,195 | 1/1967 | Hidding | 220/601 X |
| 3,474,843 | 10/1969 | Maris | 220/288 X |
| 4,313,545 | 2/1982 | Maeda | 220/601 X |

FOREIGN PATENT DOCUMENTS

| | | | |
|---|---|---|---|
| 2013567 | 9/1990 | Canada | 190/89 |
| 0074246 | 3/1983 | European Pat. Off. | B65D 1/02 |
| 359229 | 10/1931 | United Kingdom . | |
| 1402645 | 8/1975 | United Kingdom | F16K 24/00 |
| 2207653 | 2/1989 | United Kingdom | B65D 8/02 |
| 2214156 | 8/1989 | United Kingdom | B65D 8/02 |

OTHER PUBLICATIONS

"Certificate of Packaging Performance", Ser. No. 1758, Appln. No. 0327, Sep. 16, 1992.

"Certificate of Packaging Performance", Ser. No. 1963, Appln. No. 0331, Jul. 20, 1992 with accompanying pages 1 and (unnumbered).

*Primary Examiner*—Allan N. Shoap
*Assistant Examiner*—Vanessa Caretto
*Attorney, Agent, or Firm*—Reising, Ethington, Barnard, Perry & Milton

[57] ABSTRACT

A container (10) of the type having side walls and top and bottom ends, the top end (2) including an access hole 4 surrounded by an upstanding neck (5) adapted to receive a suitable closure, wherein the neck is integrally formed from the material of the top end. There is also provided a closure (12) comprising a cap having a top (13) and a skirt (15) extending downwardly therefrom, the skirt having an internal thread (12*a*) to engage the external thread of the neck, wherein the top (13*a*) of the cap is formed in a concave shape, the opposite surface (13*b*) being convex and extending downwardly towards the interior of the cap.

15 Claims, 2 Drawing Sheets

SCREW CAP CLOSURE FOR A DRUM

This invention relates to an improved neck for use with cans, tanks or drums.

Drums for carrying liquids are commonly provided with a screw cap closure means. An upstanding externally threaded neck on the top end of the drum provides access to the interior of the drum, and a complementary screw cap having a wad or seal in its inner face completes the closure. The maximum diameter of this conventional neck is in the region of 70 mm.

Conventionally, the neck is formed separately and is crimped or otherwise joined to the edge of a pressed hole in the top end of the drum. It has been found that this conventional construction of drum necks can fail the UN drop test, in which the drum, filled with liquid and closed with a suitable closure means is dropped from a predetermined height. Often, during this test, the joint between the neck and the drum end fails. It is therefore the aim of the present invention to provide a drum neck which overcomes this disadvantage, and also overcomes the restrictions caused by the relatively small diameter neck.

According to a first aspect of the present invention there is provided a container of the type having side walls and top and bottom ends, said top end including an upstanding neck adapted to receive a suitable closure means, wherein the neck is integrally formed from the material of the top end.

Preferably, the material for the neck is provided by the pressing out of the hole which provides access to the drum.

This may conveniently be achieved by arranging for the hole pressed out of the container top end to be larger than with conventional containers of this type. This provides sufficient material to simultaneously form a raised, integral neck by pressing, heat forming or other suitable process. The larger hole also allows air to enter the container at the same time as the liquid is poured out, resulting in much smoother flow.

The integrally formed neck may have a desired thread pattern either cut afterwards or integrally formed during the pressing stage. This thread pattern may for example be full, bayonet or multistart.

The size of the hole to be pressed can be varied according to the size of the drum and the height of the neck required, but a typical hole diameter would be between 10 cm and 13 cm. (4 inches to 5 inches approximately) for a 28 cm (11 inch) diameter drum with ends formed from tin plate and/or steel.

The integrally formed neck removes the need for a second neck fitting operation, and there is no weak points where a conventional neck would have been fitted.

The larger hole, as well as providing material for the integral neck, also permits easy filling and emptying of the container, and also permits the insertion of a mixing device, pump or other tool.

The container having a neck according to the present invention is preferably fitted with a closure means comprising a cap having a top and a skirt extending downwardly therefrom, the skirt being internally threaded to engage the external thread of the neck, wherein the top of the cap is formed in a concave shape, extending convexly towards the interior of the cap. A seal is preferably provided, which runs around the perimeter of the cap, between the concave top and the skirt. Conveniently, the edge of the cap skirt is turned over to form a rolled safe edge.

In the preferred embodiment of the invention, the container end is formed with an annular groove running around the outside of the neck, the purpose of this groove being to receive the rolled safe edge of the cap.

In normal use, the cap is screwed down onto the neck, until the seal presses against the neck and the curled safe edge rests in the annular groove. Should the pressure inside the container increase, such as during a drop test, the concave top of the cap will tend to flex outwardly so that it becomes flat, and this has the effect of pushing the seal into tighter contact with the neck.

During a pressure surge, as well as the top of the cap flexing in the above described manner, the skirt has a tendency to splay outwards, resulting in leakage between the cap and the neck. This problem is avoided by the interaction of the rolled safe edge on the cap and the annular groove in the container end, the edge tending to be retained by the groove.

Another preferred feature is a second annular groove in the container end, running around the neck exteriorly of the first-mentioned groove, this second groove serving to arrest generally radial fault lines or creases which tend to form during a pressure surge.

Conveniently, there may also be provided an alternative closure means in the form of a plastic cap having a pouring spout or tube, which may be screwed on to the neck, in place of the previously described cap, for dispensing small quantities of liquid. This plastic cap would be removed after use and the previously described cap replaced.

A drum having a neck according to the present invention, when fitted with the above described closure means, should pass the UN Drop Test ("Y" Category, group 2 pass) for the transportation of dangerous substances.

In a conventional drum the smaller neck is located off centre, and a fixed handle is joined to the centre of the drum end. With the provision of a larger neck in accordance with the preferred embodiment of this invention, it is convenient to locate this larger hole in the centre of the drum end, which simplifies automatic filling and to include a pivoted handle for pivoting movement about an axis which corresponds to a diameter of the drum end, the handle being pivotally mounted to the drum end by plates located on either side of the neck.

Preferably the uppermost edge of the integrally formed neck is turned over internally at the neck, for strength, improved emptying ability and safety.

According to a second aspect of the present invention there is provided a method of manufacturing a container of the type having side walls, top and bottom ends, and an upstanding neck adapted to receive a suitable closure means, wherein the method includes the step of integrally forming the neck from the material of the top end.

Whilst it is envisaged that this invention will primarily be applicable to containers of generally cylindrical configuration, it is equally applicable to any type of container of the general type described above.

Embodiments of the present invention will now be described by way of example only with reference to the accompanying drawings in which.

Figure 1:
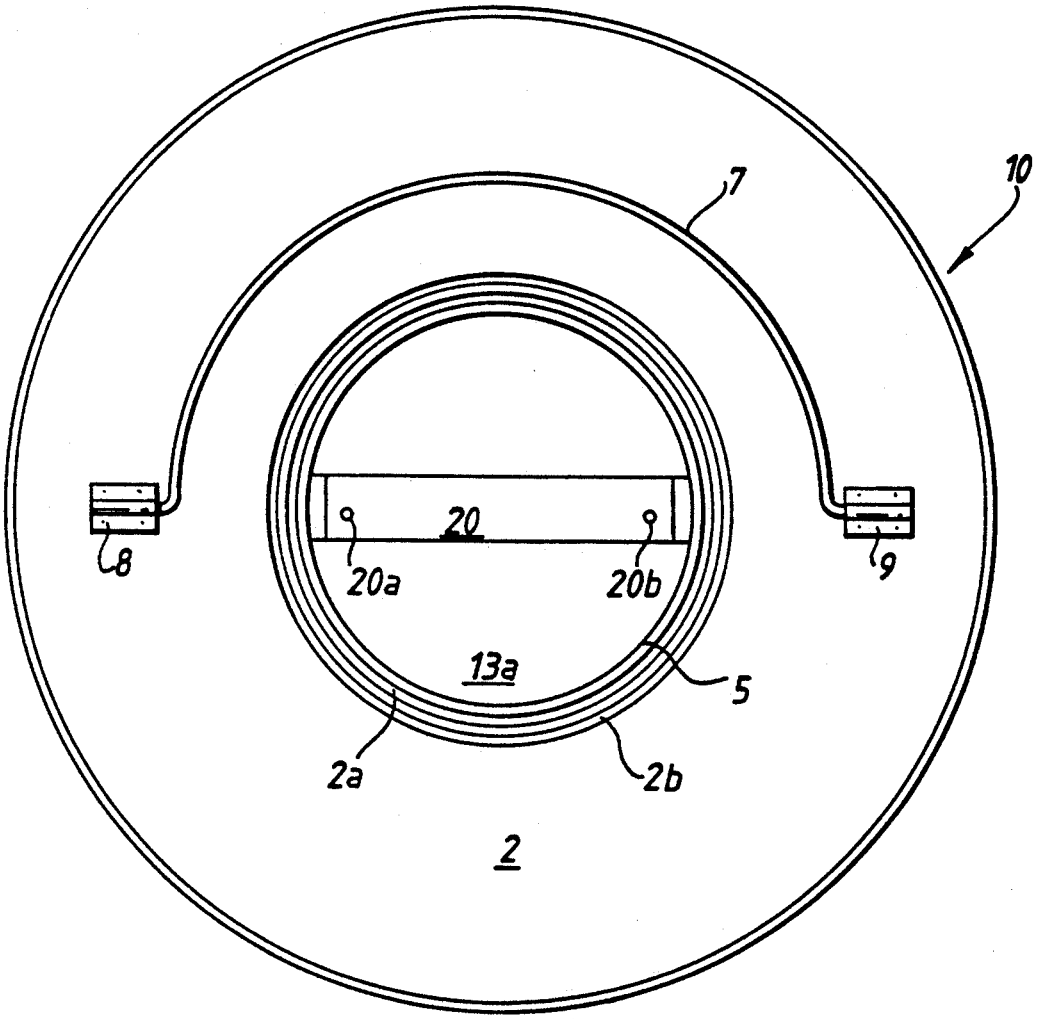
FIG. 1 is a top plan view of a drum having an integral neck and closure according to the invention.

Referring to the drawings, a container according to the present invention takes the form of a generally cylindrical 25 liter capacity drum designated generally by 10. The drum has a cylindrical side wall, a bottom end (not shown) and a top end 2.

Access to the drum is via a central hole 4 in the top end 2 which is surrounded by an upstanding neck 5 integrally formed with the drum end 2 from the material provided by the pressing out of hole 4. A pivoting handle 7 is attached to the drum end by pivot plates 8, 9 so as to pivot about a diameter of the drum end 2. This handle 7 can be pivoted to lie flat against the drum end 2 on either side of the hole 4, to provide unobstructed access to the neck 5.

Figure 2:
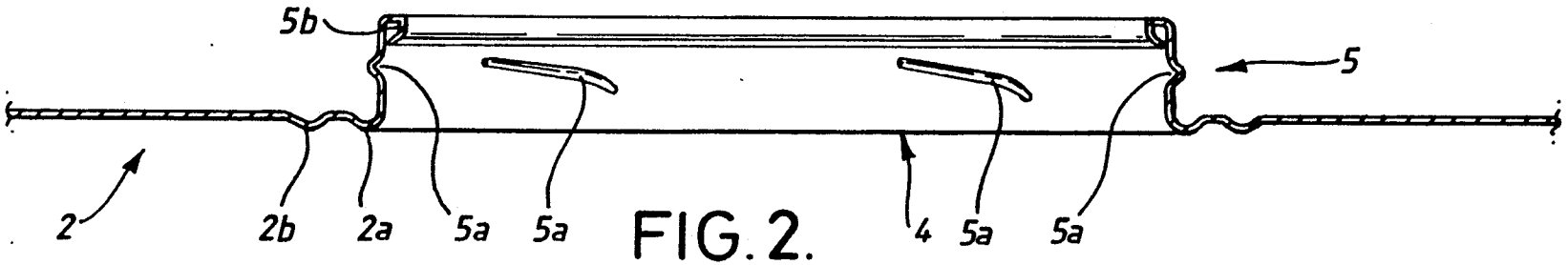
FIG. 2 is a side view of the integral neck.

FIG. 2 illustrates the integrally formed neck 5 in more detail, and in particular the bayonet thread pattern 5*a* and the edge 5*b* which is turned over internally of the neck 5.

Figure 3:
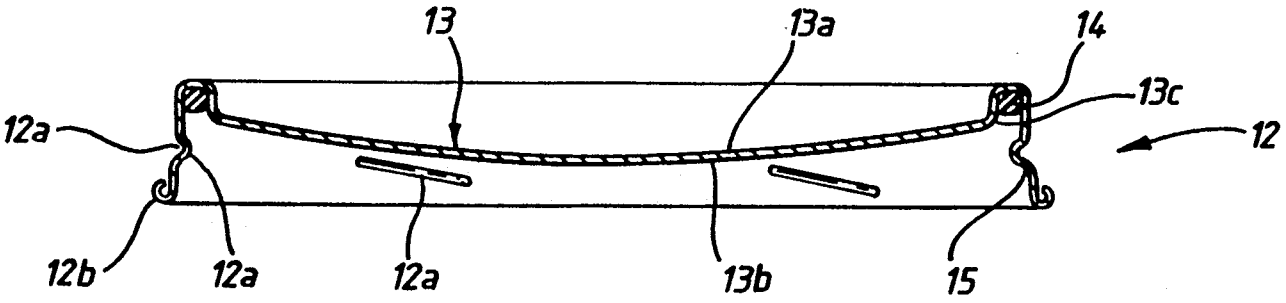
FIG. 3 is an example of a suitable closure means for use with the neck of the present invention.

The cap 12, illustrated in FIG. 3 has a top 13 and a skirt 15 extending downwardly from the top. The skirt 15 has an internal bayonet thread 12*a* which is complementary to the thread 5*a* of the neck, and a rolled safe edge 12*b*. A flowed in gasket seal 14 runs amoung the perimeter.

The upper surface 13*a* of the cap is concave, such that its opposite surface 13*b* is convex and extends downwardly into the neck 5 when the cap is screwed on to the neck. During flexing of cap top 13, the sidewall 13*c* of the cap is pushed outwardly, causing the seal 14 to be pressed more tightly against edge 5*b* of neck 5.

The top end 2 of the drum has two annular grooves 2*a* and 2*b* running around the neck 5.

The first groove 2*a* receives the rolled safe edge 12*b* of the cap 12, to hold the edge of the cap captive against lateral, splaying forces. The second groove 2*b* acts to halt creases or fault lines which tend to form in the end 2 during a pressure surge, thus maintaining the neck and its closure intact and undistorted.

Because the cap does not have to be destroyed to gain access to the container, the containers and/or the caps can be laundered and re-used, providing environmental benefits.

The upper surface 13*a* of the cap is fitted with a metal strip 20 which is spot welded to the cap at 20*a*,20*b*. This permits a torque wrench to be used to tighten the cap to the required pressure.

What is claimed is:

1. A container and closure assembly, the container being of the type having side walls and a top end and a bottom end, the top end being formed of a material and including an access hole surrounded by an upstanding neck, closure means for covering the access hole, wherein the neck is integrally formed from the material of the top end, the closure means comprising a cap having a top and a skirt extending downwardly therefrom to define an interior of the cap, the cap skirt including an edge turned over to form a rolled edge, and the top end of the container being formed with an annular groove running around the outside of the neck, said groove receiving the rolled edge of the cap when the latter is secured to the neck, thereby preventing outward splaying of the cap skirt should the container be dropped.

2. A container and closure assembly according to claim 1, wherein the neck is provided by pressing out the access hole in the top end.

3. A container and closure assembly according to claim 1 wherein the integrally formed neck has a thread pattern.

4. A container and closure assembly according to claim 1 wherein the neck includes an uppermost edge turned over internally of the neck.

5. A container and closure assembly according to claim 1 wherein the access hole has a diameter substantially greater than that of a conventional container access hole.

6. A container and closure assembly according to claim 5 wherein the diameter of the access hole is in the range of 10 cm to 13 cm.

7. A container and closure assembly according to claim 1 wherein the top end has a diametric center and the access hole is located in the center of the top end.

8. A container and closure assembly according to claim 1 wherein there is included a pivoted handle mounted to the top end, by plates located on either side of the neck, for pivotal movement about an axis which corresponds to a diameter of the top end.

9. A container and closure assembly according to claim 3, wherein the cap skirt is internally threaded to engage the thread pattern of the neck, wherein the top of the cap is formed in a domed shape, extending convexly towards the interior of the cap.

10. A container and closure assembly according to claim 9, wherein the cap includes a perimeter defined by the junction of the top and the skirt and there is provided, in the interior of the cap, a seal which runs around the perimeter.

11. A container and container closure assembly according to claim 1, wherein the container end includes a second annular groove, running around the neck exteriorly of the first-mentioned groove.

12. A container and container closure assembly according to claim 1 wherein there is provided an alternative closure means in the form of a cap having a pouring spout or tube, which may be screwed on to the neck, in place of the previously described cap, for dispensing small quantities of liquid.

13. A method of manufacturing a container and closure assembly, the container being of the type having side walls and a top end and a bottom end, the top end being formed of a material and including an access hole surrounded by an upstanding neck for receiving the closure means, and the closure comprising a cap having a top and a skirt extending downwardly therefrom to define an interior of the cap, wherein the method includes the steps of:

a) integrally forming the neck from the material of the top end, b) turning over an edge of the cap skirt to form a rolled edge and forming the length of said skirt with said rolled edge of a predetermined length, and c) forming in the top end of the container an annular groove running around the outside of the neck, said predetermined length corresponding to the length of said neck such that said groove receives the rolled edge of the cap when the latter is secured to the neck, thereby preventing outward splaying of the cap skirt should the container be dropped.

14. A container and closure assembly according to claim 3 wherein the thread pattern is formed simultaneously during formation of the neck.

15. A container and closure assembly according to claim 3 wherein the thread pattern is cut into the neck subsequent to the formation of the neck.

* * * * *